US006854907B2

(12) United States Patent
Perez et al.

(10) Patent No.: US 6,854,907 B2
(45) Date of Patent: Feb. 15, 2005

(54) METHOD FOR REMOVING ROLL-SET CURL FOR TWO-SIDED PRINTING

(75) Inventors: Maria Jesus Perez, Rubi Barcelona (ES); Roman Barba, Terrassa Barcelona (ES); Susan Nishiya, Los Angeles, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 09/850,082

(22) Filed: May 8, 2001

(65) Prior Publication Data

US 2002/0166469 A1 Nov. 14, 2002

(51) Int. Cl.[7] ..... B41J 15/02; B65H 23/34
(52) U.S. Cl. ..... 400/613.1; 613/611
(58) Field of Search ..... 400/613, 611, 400/613.1, 621

(56) References Cited

U.S. PATENT DOCUMENTS

| | | | | | |
|---|---|---|---|---|---|
| 5,940,112 | A | * | 8/1999 | Siwinski | 347/218 |
| 6,015,207 | A | * | 1/2000 | Winter et al. | 347/43 |
| 6,222,570 | B1 | * | 4/2001 | Takayama et al. | 347/172 |
| 6,313,861 | B2 | * | 11/2001 | Schartner | 347/219 |
| 6,406,126 | B1 | * | 6/2002 | Clark | 347/37 |
| 6,443,555 | B1 | * | 9/2002 | Silverbrook et al. | 347/42 |
| 2001/0055041 | A1 | * | 12/2001 | Yonekubo | 347/19 |

FOREIGN PATENT DOCUMENTS

| | | | | | |
|---|---|---|---|---|---|
| JP | 01272499 | A | * | 10/1989 | B43L/13/00 |
| JP | 04345878 | A | * | 12/1992 | B41J/21/00 |
| JP | 05155106 | A | * | 6/1993 | B41J/29/17 |
| JP | 07314832 | A | * | 12/1995 | B41J/15/16 |
| JP | 08292505 | A | * | 11/1996 | G03B/27/73 |
| JP | 09286128 | A | * | 11/1997 | B41J/2/32 |
| JP | 2001097612 | A | * | 4/2001 | B65H/18/10 |

OTHER PUBLICATIONS

English translation of JP 07–314832.*
Machine translation of JP 07314832 A from Japanese Patent Office website.*
Machine translation of Japanese patent 09286128 from Japanese Patent Office website.*

* cited by examiner

*Primary Examiner*—Daniel J. Colilla

(57) ABSTRACT

A method for substantially removing "roll-set curl" in a rolled print medium. Roll-set curl, as the name implies, may be defined as the "memory" a print medium has which causes the print medium to tend to return to the shape it had while on the core, once the print medium is unrolled. Additionally, a method for printing on both sides of a print medium in which a roll-set curl has been substantially removed. In one respect, according to a preferred embodiment, a take-up reel is utilized to substantially remove the roll-set curl.

4 Claims, 6 Drawing Sheets

METHOD FOR REMOVING ROLL-SET CURL FOR TWO-SIDED PRINTING

FIELD OF THE INVENTION

This invention relates generally to large format inkjet printers. More particularly, the invention pertains to a method for substantially removing roll-set curl in a print medium to facilitate the printing on both sides of the print medium.

BACKGROUND OF THE INVENTION

Large format ink jet printers are typically utilized to perform double-sided printing. When double-sided printing operations are conducted on cut sheets of print medium, i.e., sheets that have been packaged into various cut sizes, double-sided printing thereon may be effectuated with relative ease. However, when a print medium has been packaged in a roll, it is typically difficult to print onto both sides thereof because of roll-set curl.

By virtue of the print medium being stored as a roll, as the print medium is unrolled from a core, the print medium typically retains some level of "curliness". That is, print medium rolled on a core typically suffers from a condition known as "roll-set curl". Roll-set curl, as the name implies, may be defined as the "memory" a print medium has which causes the print medium to return to the shape it had while on the core, once the print medium is unrolled.

The roll-set curl condition often makes it relatively difficult to load the print medium to print on the second side of the print medium. In one respect, the roll-set curl may raise the print medium in the print medium path, thus placing it in a position for a carriage of a large format printer to crash into the print medium during a printing operation.

As discussed hereinabove, one known manner of printing on both sides of a print medium is to use cut sheets. Another conventional manner of printing on both sides of a print medium is to print on one side of a print medium from a roll, cutting the print medium, and then reloading the sheet back into the printer device. However, both of the above-described manners of printing on both sides of a print medium limit the length of an obtainable printed output. That is, conventional techniques of double-sided printing are incapable of producing relatively long plot streams printed on both sides of a print medium.

SUMMARY OF THE INVENTION

According to the principles of the present invention, a method of removing roll-set curl in a print medium rolled on a core utilizing a large format printer equipped with a take up reel ("TUR") having a core is described. In the method, the TUR is activated and the rolled print medium is loaded into the large format printer. The rolled print medium is advanced through the large format printer until a front edge of the rolled print medium is adjacent to the TUR core. The front edge of rolled print medium is adhered to the core of the TUR. The core of the TUR is rotated in a direction substantially opposite a direction of the rolled print medium on the core to substantially wind the rolled print medium on to the core of the TUR.

According to another aspect, the present invention pertains to a method of printing on both sides of a print medium rolled on a core utilizing a large format printer equipped with a take up reel ("TUR") having a first core. According to the method, the TUR is activated and the rolled print medium is loaded into the large format printer. A plot stream is sent to the large format printer and printed onto a first surface of the rolled print medium. The rolled print medium is advanced through the large format printer until a front edge of the rolled print medium is adjacent to the first core of the TUR. The front edge of the rolled print medium is adhered to the first core of the TUR. The first core of the TUR is wound in a direction substantially opposite a direction of the print medium roll to substantially wind the rolled print medium on to the first core of the TUR.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to exemplary embodiments thereof, particularly with references to printing plot streams in large format ink jet printers. However, one of ordinary skill in the art would readily recognize that the same principles are equally applicable to any type of print operation, and can be implemented in, any device that may benefit from the principles of the present invention, and that any such variation would be within such modifications that do not depart from the true spirit and scope of the present invention. Thus, although the present invention is described with particular reference to large format ink jet printers and to the printing of plot streams, it will be apparent to one of ordinary skill in the art that the present invention may be practiced with any other suitable printing device and with various other types of printable executable files.

Figure 2:
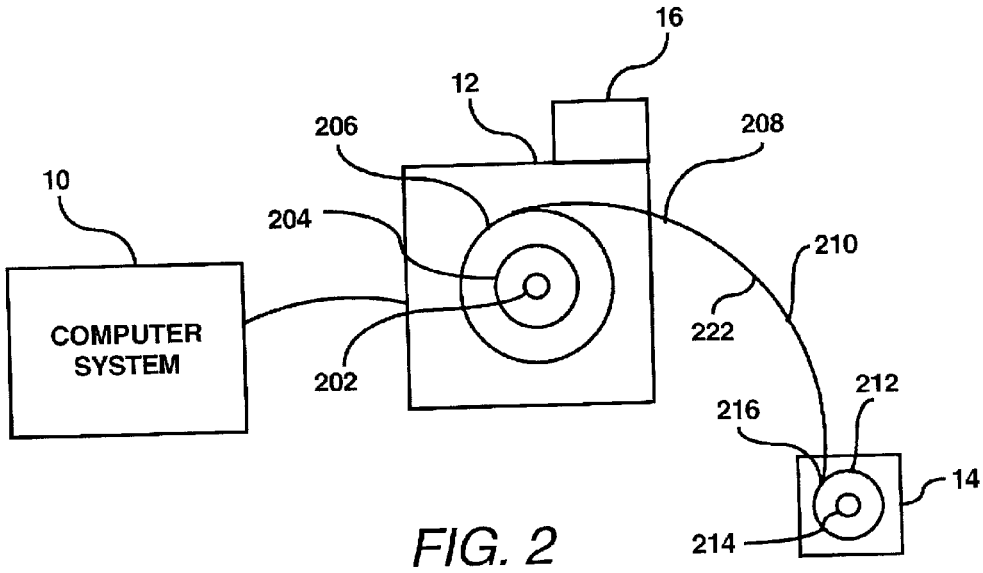
FIG. 2 is a schematic illustration of a manner in which a print medium having one side printed upon is attached to a take up reel in accordance with the principles of the present invention.

Although the present invention may be used in any printing environment which incorporates thermal ink jet technology, the presently preferred embodiment of the present invention is used in a large format ink jet printer which is schematically illustrated in FIG. 2. More particularly, the presently preferred embodiment of the present invention is implemented in a Hewlett Packard 5000 large format ink jet printer. Additionally, the preferred embodiment of the present invention is implemented in a printing environment having a take-up reel 14 ("TUR") that may be attached to a large format ink jet printer 12.

As schematically illustrated in FIG. 2, the TUR 14 is generally positioned below an output portion of a large format printer 12 to receive a print medium during printing thereon. In this respect, the TUR 14 typically possesses a first TUR core 212 upon which a print medium is to be rolled as the print medium is printed upon by the large format printer 12. In general, the first TUR core 212 is typically 36" in length, however, the present invention is not limited to the use of a 36" long core. Rather, the present invention may utilize a first TUR core 212 having any reasonably suitable length. The TUR 14 also typically possesses a spindle 214 for winding the first TUR core 212 to thereby enable the print medium to become rolled on the first TUR core as it exits the printer 12.

According to the principles of the present invention, as also schematically illustrated in FIG. 2, the printer 12 may receive data (e.g., plot streams) to print from a host device, e.g. computer system 10. Additionally, the printer 12 typically possesses a display 16 through which a plurality of printer options may be viewed and altered.

Generally speaking, the present invention pertains to a manner of substantially removing roll-set curl in a print medium. In addition, the present invention pertains to a manner of printing on both sides of a print medium in which roll-set curl has been substantially removed. In one respect, according to a preferred embodiment of the present invention, and as will be better realized from the following disclosure, the TUR 14 is utilized to substantially remove the roll-set curl in a rolled print medium.

Figure 1A:
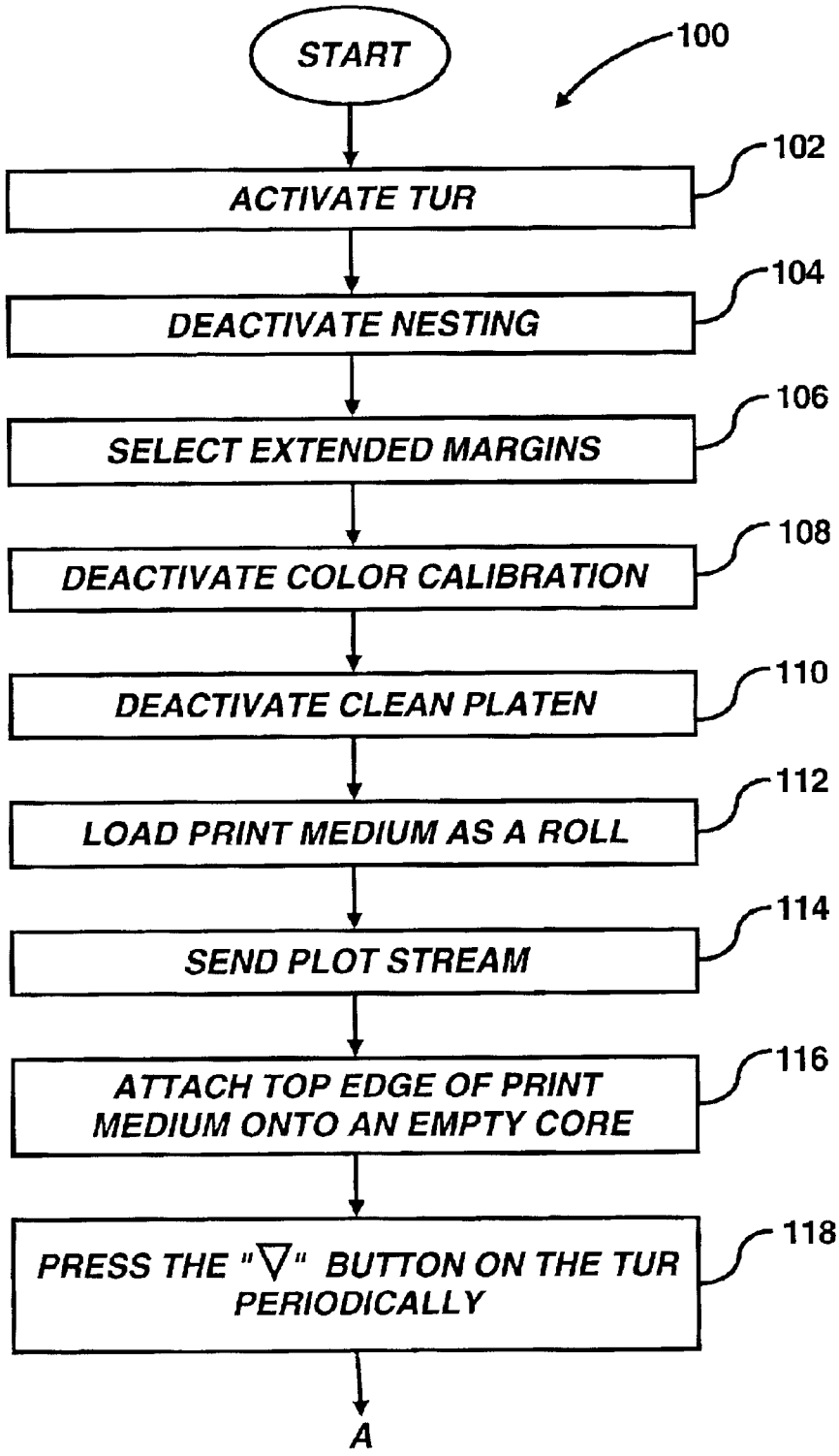
FIGS. 1A–1C together illustrate a flow diagram depicting a manner in which roll-set curl in a rolled print medium may be substantially removed to facilitate two-sided printing on the print medium in accordance with the principles of the present invention.
Figure 1B:
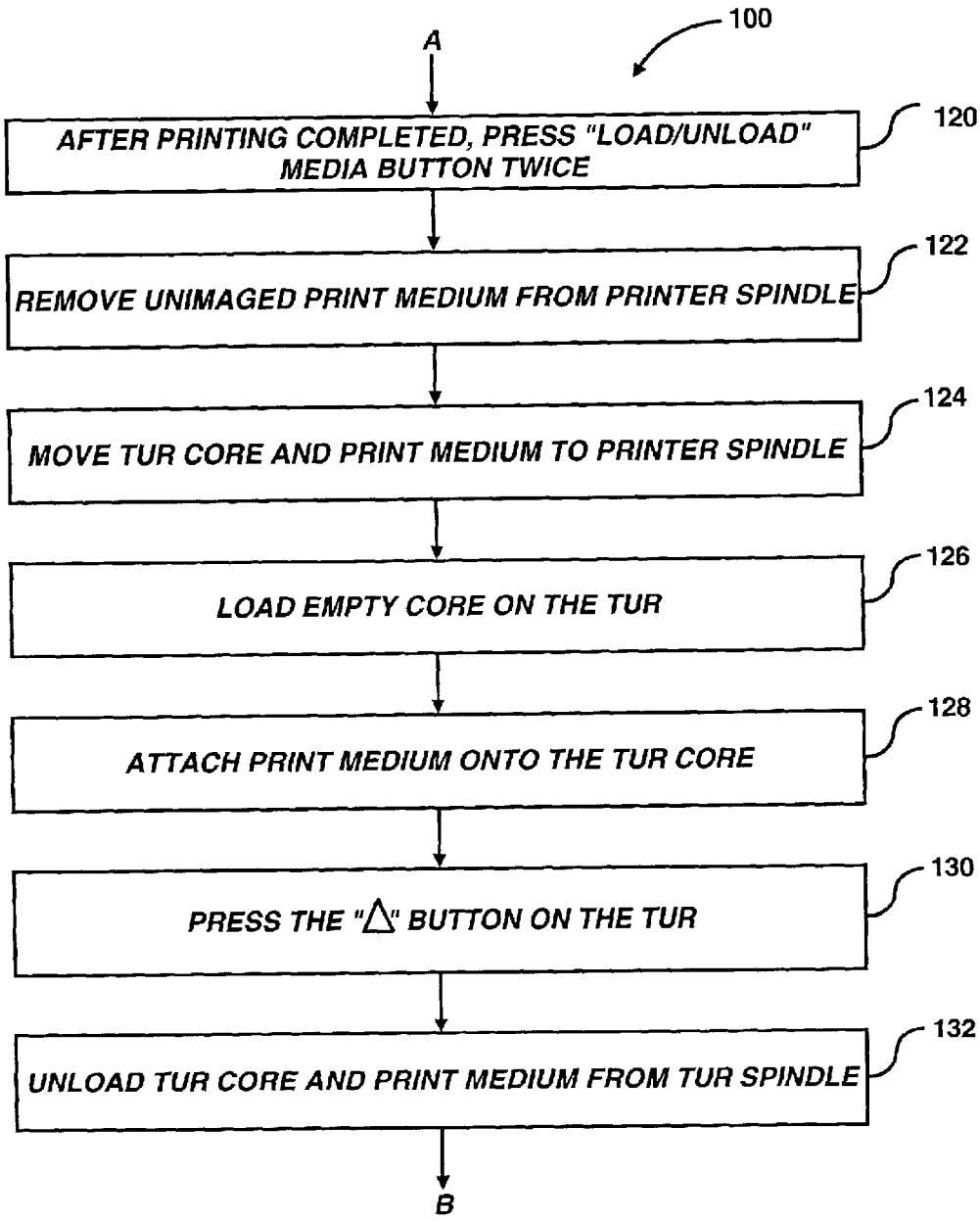
Figure 1C:
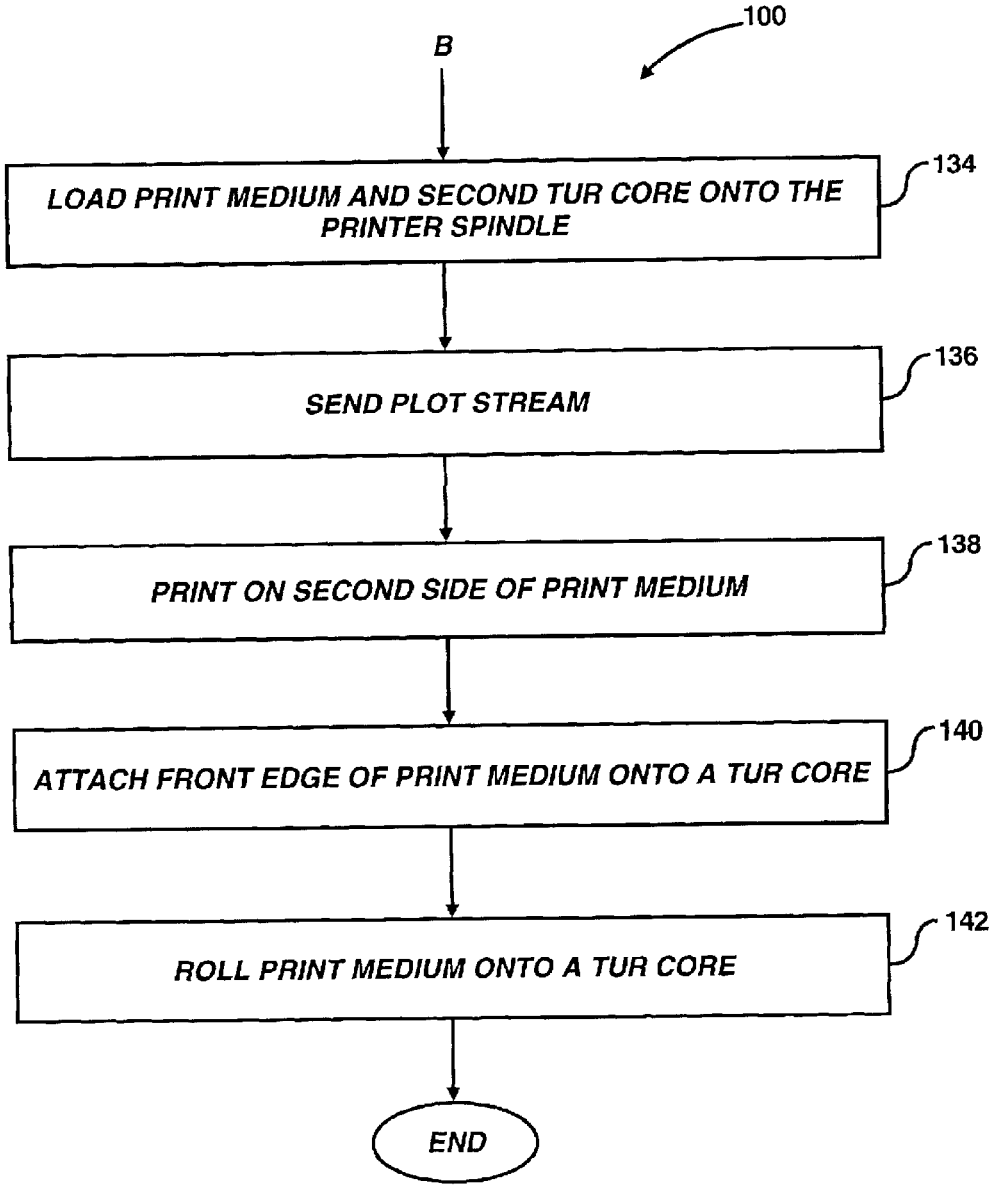

FIGS. 1A–1C, together, illustrate a flow diagram 100 depicting a manner in which roll-set curl in a rolled print medium may be substantially removed to facilitate two-sided printing on the print medium, in accordance with the principles of the present invention. Referring first to FIG. 1A, the TUR 14 is activated at step 102. The TUR 14 is activated by selecting, in the printer display 16, a printer icon, which then activates a printer setup options menu possessing the option to activate the TUR.

Once the TUR 14 has been activated, certain parameters for the printing operation may be set. In this regard, the "Nesting" feature may be deactivated as indicated in step 104. The nesting feature typically enables images to be printed side-by-side on the print medium rather than one after the other, to avoid wasting print medium. This feature may typically be implemented in those situations where the images have a relatively smaller width than the print medium, making it possible to print more than one image across the width of the print medium. During double sided printing, if the nesting feature is activated, the images printed on one side may not match with the images printed on the second side for a variety of reasons (e.g., mirroring effect, an uneven distribution of the images through the print medium width, etc.). Thus, it is advantageous to disable the nesting feature when printing on both sides of a print medium.

In a HP 5000 ink jet printer, for example, the nesting feature may be deactivated by selecting the printer icon on the front panel display of the printer, selecting the "Nesting and Queue Management" menu, selecting "Nest", and choosing the "Off" option.

An additional parameter to set for the printing operation includes the activation of the extended margins feature as indicated in step 106. Activation of the extended margins feature typically extends the unprinted margins on the print medium (e.g., from 7 mm to 15 mm lateral and frontal margins). In one respect, the extended margins feature may be activated to avoid lateral head crashes when printing the second side due to potential surface deformations caused by the printing onto the first side, to facilitate the trimming of the lateral margins in case there is relative skew in the loaded print medium, etc. In a HP 5000 ink jet printer, for example, the extended margins feature may be activated by selecting the printer icon on the front panel display 16 of the printer 12, selecting "extended margins", and choosing the "On" option.

Yet another parameter to set for the printing operation includes the deactivation of the color calibration feature as indicated in step 108. Typically, the color calibration feature operates to improve the color consistency between images, and from one image to another. In this respect, the printer 12 typically calibrates the color by printing a "calibration strip" and scanning the strip with an optical sensor. By virtue of the sensed calibration strip, the printer 12 applies the color correction to subsequently printed images. The color calibration feature is typically performed when a print head is replaced or for each newly introduced print media type that has not previously been calibrated for the current set of print heads. In general, when a print head is changed in the middle of a plot stream, and the color calibration feature is activated, the calibration strip is typically printed, thus modifying the margins between the images and causing a variation in the colors between the printed images, and further causing a mismatch between the samples printed on the first printed side and the second side. In a HP 5000 printer, for example, the color calibration feature may be deactivated by selecting the printer icon on the front panel display of the printer, selecting an "Internal RIP" settings menu, selecting "Color Calibration", and choosing the "Off" option.

Another parameter to set for the printing operation includes the deactivation of the "Clean Platen" feature as indicated in step 110. The clean platen feature is typically activated to avoid the formation of marks underneath the print medium caused by accumulated ink deposits on the platen. In this respect, the clean platen feature generally operates to remove accumulated ink deposits from the platen by utilizing the loaded print medium. More specifically, the printer 12 generally moves a portion of the print medium forwards and backwards over the platen to remove the ink deposits. According to a preferred embodiment, the platen is manually cleaned prior to printing on the first side of the print medium and the clean platen feature is deactivated to avoid ink marks from being placed on the second side of the print medium. In a HP 5000 printer, for example, the clean platen feature may be deactivated by selecting a printer icon on the front panel display of the printer, selecting "utilities/clean platen/automatic clean", and choosing the "Off" option.

Although specific reference has been made hereinabove with respect to the setting of certain parameters prior to initiation of the printing operation, it to be understood that the present invention may be practiced without following all of the enumerated steps. In addition, it is also within the scope and spirit of the present invention that the parameters may be implemented in any order.

Once the above-printing operation parameters have been set, the print medium may be installed onto the printer 12 at step 112. Referring now to FIG. 2, this step typically includes the positioning of a spindle 202 of the printer 12 into the core 204 of a rolled print medium 206 in such a manner as to enable the print medium 208 to be substantially accurately fed into a printing area of the printer. That is, in a HP 5000 printer, for example, a leading edge of the print medium is visible and inserted into the printer such that a first printing side is positioned to be printed upon. As illustrated in FIG. 1A, the step following the print medium installation step typically includes the sending of plot stream information to the printer 12 from the computer 10 system as indicated in step 114. However, it is to be understood that the plot stream may be sent to the printer 12 prior to the print medium 208 installation step without departing from the spirit and scope of the present invention. In either event, as the printer 12 prints onto a first surface 210 of the print medium 208, the print medium is advanced through the printer. When a sufficient length of the print medium has advanced through the printer 12, i.e., a front edge of the print medium 208 is adjacent to the TUR, the front edge 216 of the print medium is attached to a first TUR core 212 as indicated in step 116. The front edge 216 of the print medium 208 may be attached to the first TUR core 212 by any known removable fastening means, e.g., adhesive, adhesive tape, mechanical fasteners, etc. Additionally, the front edge 216 of the print medium 208 is attached to a first TUR core 212, such that the first surface 210 of the print medium is in contact with an outer surface of the first TUR core, as illustrated in FIG. 2.

According to a preferred embodiment of the present invention, the front edge 216 of the print medium 208 is attached to the first TUR core 212 in such a manner as to substantially prevent the printed image on the first surface 210 from becoming damaged. In this respect, adhesive tape that does not leave any residue is preferred as well as ensuring that the tape is only placed around the edges of the print medium 208 without substantially overlapping the printed image. Additionally, it is preferable to utilize TUR cores that are substantially free of any materials that may be transferred or otherwise damage the printed side of the print medium.

Referring once again to FIG. 1A, once the front edge of the print medium is attached to the first TUR core 212, an advance button "▽" located on the TUR 14 is depressed periodically to rotate the first TUR core and thus roll the print medium 208 onto the first TUR core as indicated in step 118. Referring back to FIG. 2, the first TUR core 212 is positioned over a TUR spindle 214, which enables the first TUR core to be rotated in either direction. Because the TUR 14 is typically equipped with a sensor to automatically detect when a sufficient length of the print medium 208 has advanced to thus signal the TUR spindle 214 to roll in a direction opposite the direction that the print medium has been installed on the first TUR core 212, according to a preferred embodiment, a sensor located on the TUR may be blocked to avoid the automatic re-rolling of the print medium in the opposite direction.

Referring now to FIG. 1B, after the plot stream information has been printed onto the first surface 210 of the print medium 208, a "Load/Unload" button on the printer front panel (not shown) is depressed twice as indicated in step 120. In response to the first depression of the "Load/Unload" button, the printer 12 typically operates to cut the print medium 208. In response to the second depression of the "Load/Unload" button, the printer 12 typically operates to release the rolled print medium 206 and its core 204 from the spindle 202.

Figure 3A:
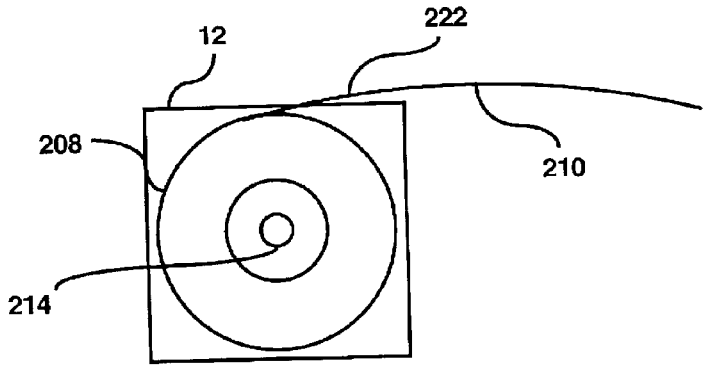
FIGS. 3A and 3B are schematic illustrations of a manner in which a print medium rolled onto a take up reel is attached to a printer spindle in accordance with the principles of the present invention.

After the printing operation on the first surface 210 of the print medium 208 is complete, the remaining portion of the print medium may be rolled onto the first TUR core 212. The unused portion, if any, of the rolled print medium 206 and the core 204 are removed from the printer spindle 202 as indicated in step 122. Additionally, the first TUR core 212 and the print medium 208 may be removed from the TUR 14 and installed on the printer spindle 202 as indicated in step 124. In performing step 124, as illustrated in FIG. 3A, the print medium 208 rolled onto the first TUR core 212 is removed from the TUR spindle 214 (FIG. 3A) and installed on the printer spindle 202 (FIG. 3B), such that the first surface 210 possessing the printed plot stream remains in a position substantially facing the printer spindle.

Although the description of the present invention above made particular reference to printing on a surface 210 of the print medium 208, it is to be generally understood that certain of the steps involved for the printing operation may be omitted to substantially remove the roll-set curl in the print medium. It is thus within the principles of the present invention to install the print medium 208 in the manner illustrated in FIG. 2 and roll the print medium onto the first TUR core 212 without printing on a surface of the print medium.

Figure 3B:
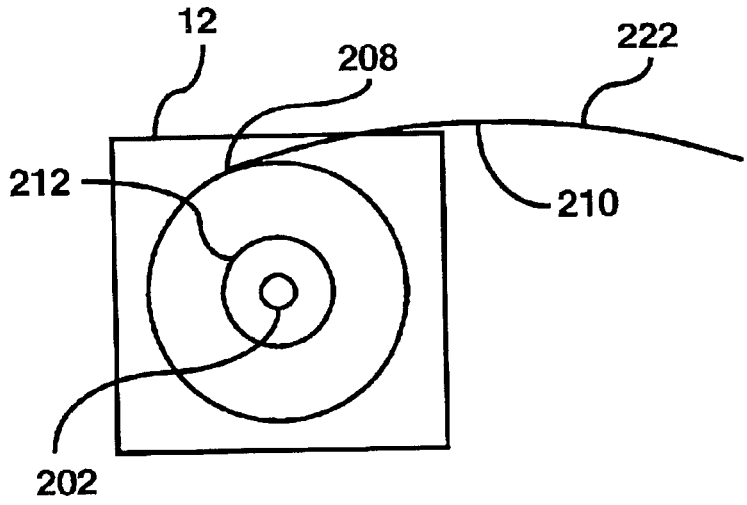
Figure 4:
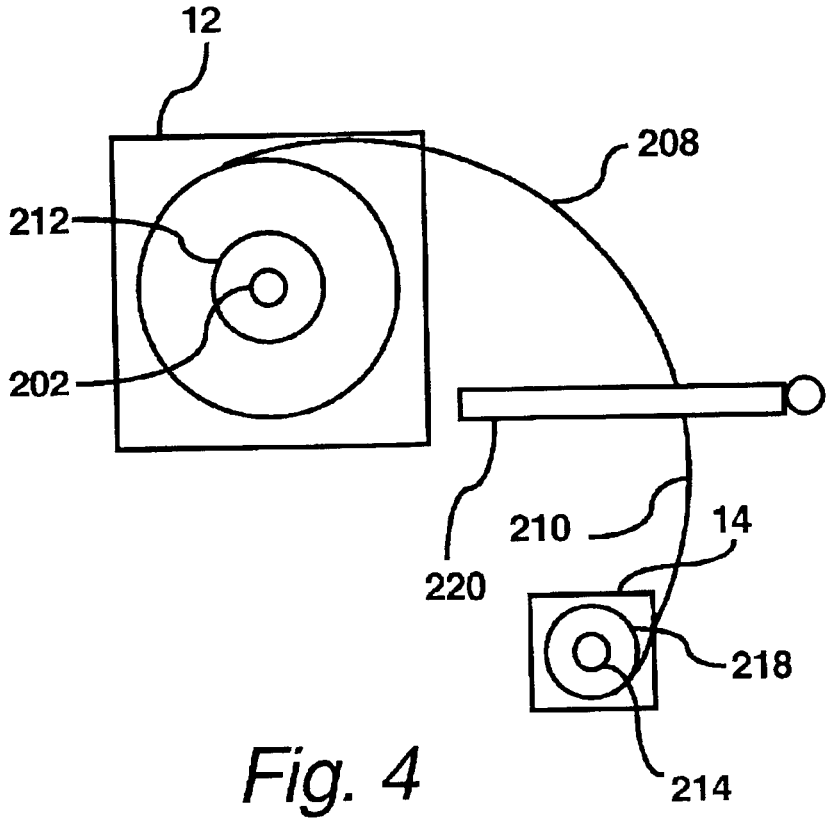
FIG. 4 is a schematic illustration showing a manner of rolling a print medium from a printer to a TUR core to prevent a printed side of the print medium from becoming damaged during the print medium rolling operation.

The print medium 208 and the first TUR core 212 may be installed on the printer spindle 202 as illustrated in FIG. 3B. When the print medium 208 is installed on the printer spindle 202 in this manner, an image printed on the second surface 222 will be in one direction with respect to the image printed on the first surface 210. However, if it is desired to print the image on the second surface 222 in the other direction with respect to the image printed on the first surface 210, the plot stream may be sent to the printer in reverse order. According to a preferred embodiment, the print medium 208 may be rolled onto a second TUR core 218. In this respect, as indicated in step 126, the second TUR core 218 is installed on the TUR spindle 214 in the manner illustrated in FIG. 4. Additionally, as indicated in step 128, the print medium is attached to the second TUR core 218 by any known removable fastening means, e.g., adhesive, adhesive tape, mechanical fasteners, etc. As seen in FIG. 4, the print medium 208 is unrolled from the first TUR core 212 and a front edge of the print medium 208 is attached to the second TUR core 218 in a manner similar to that described hereinabove with respect to the first TUR core 212. That is, the print medium 208 is attached to the second TUR core 218 with the first surface 210 facing the second TUR core. Thus, the print medium 208 is attached to the second TUR core 218 in a manner which enables the print medium to be rolled onto the second TUR core in a direction opposite the first TUR core 212. As indicated in step 130, once the print medium 208 is attached to the second TUR core 218, an advance button "△" located on the TUR 14 is depressed periodically to rotate the second TUR core 218 and thus roll the print medium 208 onto the second TUR core.

Referring back to FIG. 4, the printer 12 typically possesses a deflector bar 220 over which print medium 208 typically passes after it has been printed upon. However, because the first surface 210 has an image printed thereon, it has been found to be advantageous to prevent the print medium 208 from passing over the deflector bar 220 by positioning the printed print medium generally behind the deflector bar as illustrated in FIG. 4.

Once the print medium 208 has been rolled onto the second TUR core 218, the second TUR core and the print medium are removed from the TUR spindle 214 as indicated in step 132. As the print medium 208 is rolled onto the second TUR core 218, a "telescoping" effect may occur causing the print medium to be skewed on the second TUR core. One relatively simple manner in which the "telescoping" effect may be removed involves the lifting of the print medium 208 and the second TUR core 218 off the ground a relatively short distance (e.g., 2 inches) and relatively gently dropping the second TUR core and the print medium on the ground.

Figure 5:
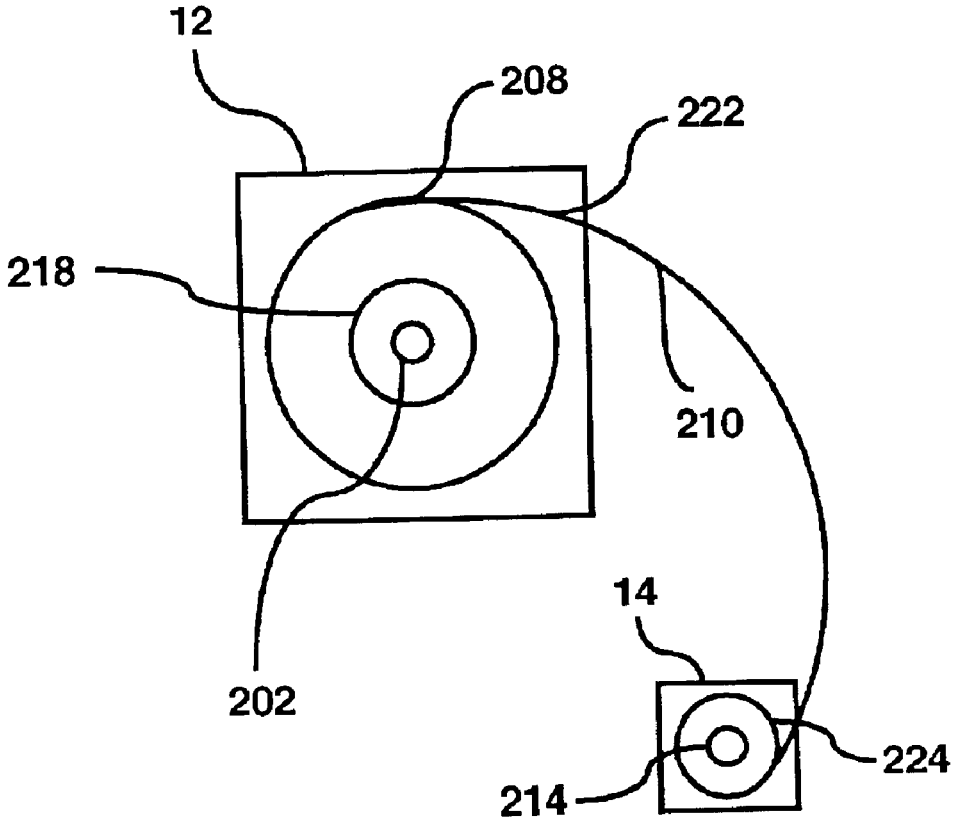
FIG. 5 is a schematic illustration showing a manner of printing onto a second side of a rolled print medium after a print medium has been rolled onto a TUR core.

Referring now to FIG. 1C, the second TUR core 218 and the print medium 208 are installed on the printer spindle 202 as indicated in step 134. In following this step, the second TUR core 218 and the print medium 208 may require a 180° rotation across the vertical axis to assign the print medium in proper position for printing onto the second side of the print medium (e.g., in a HP 5000 printer). Once the print medium 208 is installed on the printer spindle 202, as illustrated in FIG. 5, step 136 typically includes the sending of plot stream information to the printer 12 from the computer system 10. However, it is to be understood that the plot stream may be sent to the printer 12 prior to the installation of the print medium 208 without departing from the spirit and scope of the present invention. In either event, as the printer 12 prints onto the second surface 222 of the print medium 208, as in step 138, the print medium is advanced through the printer and exits out of the printer. When a sufficient length of the print medium 208 has advanced through the printer 12, i.e., the print medium is adjacent to a third TUR core 224, the print medium is attached to the third TUR core 224 at step 140. The print medium 208 may be attached to the third TUR core 224 by any known removable fastening means, e.g., adhesive, adhesive tape, mechanical fasteners, etc. Additionally, the print medium 208 is attached to the third TUR core 224 such that the first surface 210 of the print medium is in contact with an outer surface of the third TUR core as illustrated in FIG. 5. As the plot stream information is printed onto the second surface 222 of the print medium 208, the print medium exiting the printer 12 is rolled onto the third TUR core 224 as indicated in step 142.

As described hereinabove, the present invention pertains to a method of removing roll-set curl in a rolled print medium to facilitate double-sided printing of relatively long plot streams.

What has been described and illustrated herein are preferred embodiments of the invention along with some of their variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant current their broadest reasonable sense unless otherwise indicated.

What is claimed is:

1. A method of removing roll-set curl from a print medium rolled on a core utilizing a large format printer equipped with a take up reel ("TUR"), the method comprising:

activating a TUR having a first core;

loading the rolled print medium into the large format printer;

advancing the rolled print medium through the large format printer until a front edge of the rolled print medium is adjacent to the TUR;

attaching the front edge of the rolled print medium to the first core of the TUR;

substantially removing roll-set curl from the rolled print medium by rotating the first core of the TUR in a direction substantially opposite a direction of the print medium roll to substantially wind the rolled print medium on to the first core of the TUR without printing on the rolled print medium;

removing the first core of the TUR and the print medium wound on the first core;

placing the first core of the TUR and the wound print medium onto a spindle of the large format printer, such that a first side of the rolled print medium is positioned to be printed upon by the large format printer;

sending a first plot stream to the large format printer;

placing a second core into the TUR;

winding the wound print medium from the first core to the second core; and printing an image corresponding to the first plot stream on the first side of the rolled print medium while winding the wound print medium from the first core to the second core.

2. The method of claim 1, further comprising performing one or more acts chosen from a group consisting of: turning off a nesting feature in a front panel of the large format printer, turning on an extended margins feature in the front panel of the large format printer, deactivating a color calibration feature by turning off the color calibration feature in the front panel of the large format printer and deactivating a clean platen feature by turning off the clean platen feature in the front panel of the large format printer.

3. A method of removing roll-set curl from a print medium rolled on a core utilizing a large format printer equipped with a take up reel ("TUR"), the method comprising:

activating a TUR having a first core;

loading the rolled print medium into the large format printer;

advancing the rolled print medium through the large format printer until a front edge of the rolled print medium is adjacent to the TUR;

attaching the front edge of the rolled print medium to the first core of the TUR;

substantially removing roll-set curl from the rolled print medium by rotating the first core of the TUR in a direction substantially opposite a direction of the print medium roll to substantially wind the rolled print medium on to the first core of the TUR without printing on the rolled print medium;

removing the first core of the TUR and the print medium wound on the first core;

placing the first core of the TUR and the wound print medium onto a spindle of the large format printer, such that a first side of the rolled print medium is positioned to be printed upon by the large format printer;

sending a first plot stream to the large format printer;

placing a second core into the TUR;

winding the wound print medium from the first core to the second core;

printing an image corresponding to the first plot stream on the first side of the rolled print medium while winding the wound print medium from the first core to the second core;

placing a third TUR core into the TUR;

attaching the front edge of the print medium to the third TUR core;

sending a second plot stream to the large format printer;

winding the print medium onto the third TUR core; and printing an image corresponding to the second plot stream on a second side of the rolled print medium while winding the wound print medium from the second core to the third core.

4. The method of claim 3, further comprising performing one or more acts chosen from a group consisting of: turning off a nesting feature in a front panel of the large format printer, turning on an extended margins feature in the front panel of the large format printer, deactivating a color calibration feature by turning off the color calibration feature in the front panel of the large format printer and deactivating a clean platen feature by turning off the clean platen feature in the front panel of the large format printer.

* * * * *